US006830490B2

(12) United States Patent
Murakami et al.

(10) Patent No.: US 6,830,490 B2
(45) Date of Patent: Dec. 14, 2004

(54) BATTERY TERMINAL AND BATTERY POST ADAPTOR

(75) Inventors: Takao Murakami, Shizuoka (JP); Masaru Fukuda, Shizuoka (JP); Keiichi Ito, Aichi (JP); Kazuyuki Shiraki, Aichi (JP); Masanori Wakui, Aichi (JP)

(73) Assignee: Yazaki Corporation, Tokyo (JP)

( * ) Notice: Subject to any disclaimer, the term of this patent is extended or adjusted under 35 U.S.C. 154(b) by 411 days.

(21) Appl. No.: 09/873,364

(22) Filed: Jun. 5, 2001

(65) Prior Publication Data

US 2001/0051469 A1 Dec. 13, 2001

(30) Foreign Application Priority Data

Jun. 5, 2000 (JP) ..... P.2000-167789
Jun. 5, 2000 (JP) ..... P.2000-167811
Jun. 5, 2000 (JP) ..... P.2000-167843
Jun. 5, 2000 (JP) ..... P.2000-167847
Jun. 5, 2000 (JP) ..... P.2000-167852
Jun. 5, 2000 (JP) ..... P.2000-167858

(51) Int. Cl.[7] ..... H01R 4/30
(52) U.S. Cl. ..... 439/755; 439/762
(58) Field of Search ..... 439/754–755, 439/759, 761–764, 769, 772–773, 258, 266, 522, 771, 751

(56) References Cited

U.S. PATENT DOCUMENTS 4,695,118 A 9/1987 Magdesyan et al.
4,747,793 A * 5/1988 Fukuda et al. ..... 439/766
5,021,013 A * 6/1991 Wiesler ..... 439/755
5,498,178 A * 3/1996 Tabata ..... 439/762
5,584,730 A * 12/1996 Tabata ..... 439/762
5,595,510 A 1/1997 Obligar
5,672,442 A * 9/1997 Burnett ..... 429/121
5,738,552 A * 4/1998 Halbach et al. ..... 439/762
6,227,914 B1 * 5/2001 Lee et al. ..... 439/754

FOREIGN PATENT DOCUMENTS

JP 6-60053 8/1994
JP 9-289009 11/1997
JP 11-329400 11/1999

OTHER PUBLICATIONS

Patent Abstract of Japan, 11–329400, Nov. 30, 1999.

* cited by examiner

*Primary Examiner*—Michael C. Zarroli
(74) *Attorney, Agent, or Firm*—Sughrue Mion, PLLC

(57) ABSTRACT

An adapter has a cylindrical body which is screwed onto a battery post, and a flange portion formed on a top portion of the cylindrical body to be clamped by a screwing tool. A terminal body includes a substantially U-shaped adaptor fitting portion which accommodates the adapter therein, and a seat portion on which an electric wire terminal is fixed. A lever includes a cam portion and is supported on the terminal body so as to be pivotable between a first position and a second position. A space in which the flange portion is capable of passing through is secured inside of the adaptor fitting portion when the lever is in the first position. The cam portion is abutted against an outer periphery of the cylindrical body of the adaptor so that the adaptor is retained between the cam portion and an inner face of the adaptor fitting portion, when the lever is in the second position. The flange portion of the adaptor is engaged with a top end face of the adapter fitting portion of the terminal body.

46 Claims, 15 Drawing Sheets

BATTERY TERMINAL AND BATTERY POST ADAPTOR

BACKGROUND OF THE INVENTION

The present invention relates to battery terminals which are connected to electrodes of batteries (battery posts) to be mounted in automobiles, for example, and more particularly to a battery terminal attachable to and detachable from a battery post in one touching by pivoting an operating lever (a cam lever) without using any clamping tool such as an impact wrench or the like.

The present invention also relates to a battery post adaptor which is fitted to a stud bolt type battery post to ensure that the press-fitting of the battery terminal is facilitated.

It has heretofore been practiced to fit a battery post adaptor to a stud bolt type battery post to ensure that the press-fitting of a battery terminal is facilitated. In this case, there exists a related battery post adaptor as shown in FIG. 12.

In FIG. 12, a battery post adaptor 2 is such that a circular flange portion 3 for preventing a battery terminal from slipping out is provided at the upper end of a tubular terminal mounting portion 2*a* having an internal thread 2*b* into which an external thread 1*a* of a battery post 1 is fitted, and that a hexagonal portion 4 as the fitting portion of a tool for fastening the adaptor tight is provided at the lower end of the terminal mounting portion 2*a*.

In this case, the total height required of the battery post adaptor is equal in height to a total of three portions including the terminal mounting portion 2*a*, the flange portion 3 and the hexagonal portion 4.

As shown in FIG. 13, further, the maximum dimension in the diametric direction has had to be determined by the apex-to-apex dimension F of the hexagonal portion 4 under a condition that the face-to-face dimension B of the hexagonal portion 4 is set greater than the diameter D of the flange portion 3 in view of the fact that the battery post adaptor 2 is fitted up with an impact wrench 5.

Therefore, a major problem is that as the battery post adaptor 2 tends to become large in both its height and width directions, a battery terminal to be fitted thereto is also large-sized.

As disclosed in Japanese Utility Model Publication No. 6-60053U, for example, there is a known battery terminal detachable from a battery post by pivoting an operation lever.

FIG. 14 shows the construction of the battery terminal described in the above publication. The battery terminal 30 is formed with a cam lever (an operation lever) 32 that is pivotally fitted to a terminal body 31 comprising a C-shaped adaptor fitting portion 33 and a pair of folded-back pieces 34 and 35 extending in parallel to each other from both the respective ends of the C-shaped adaptor fitting portion 33. A pivotal shaft 36 is fitted to the pair of folded-back pieces 34 and 35, the cam lever 32 being pivotally supported by the pivotal shaft 36. Electric wires W are connected to one folded-back piece 34.

The operation will be described with reference to FIGS. 15 and 16. While the cam lever 32 is uprighted as shown in FIG. 15, the cam portion 32*a* of the cam lever 32 is also kept upright and the caliber of the adaptor fitting portion 33 of the battery terminal 30 grows large. Consequently, a battery post 40 can easily be fitted into the adaptor fitting portion 33 in the above condition.

After the battery post 40 is fitted into the adaptor fitting portion 33, the cam lever 32 is turned laterally toward the pair of folded-back pieces 34 and 35 as shown in FIG. 16, whereby to make the cam portion 32*a* press the peripheral face of the battery post 40. Then a counterforce resulting from the pressing force of the cam portion 32*a* causes the inner peripheral face of the adaptor fitting portion 33 of the battery terminal 30 to be pressed against the peripheral face of the battery post 40. Consequently, the frictional force between the inner peripheral face of the adaptor fitting portion 33 and the outer peripheral face of the battery post 40 connects the battery terminal 30 to the battery post 40 electrically and mechanically.

In case where the cam lever 32 is uprighted in the above condition, on the other hand, the battery terminal 30 can be removed from battery post 40 in one touching because the pressing force of the cam portion 32*a* toward the battery post 40 is released.

Therefore, with this battery terminal 30, the battery terminal 30 can easily be attached to and detached from the battery post 40 through the operation of uprighting and turning the cam lever 32 laterally in one touching.

However, as shown in FIG. 17, though it has heretofore been arranged to make the pressing force of the cam portion 32*a* act on the outer peripheral face of the battery post 40 by securing a predetermined overlap margin δ1 between the cam portion 32*a* and the battery post 40, there is no portion for absorbing the overlap margin δ1 because the cam lever 32 that is made of solid and rigid material, and this makes a great operation force necessary to pivot the cam lever. Moreover, as there is the probability that the battery post 40 would be deformed (dented) by the overlap margin δ1 or that the cam portion 32*a* would be deformed, the contact load has not been stabilized, thus resulting in low contact reliability.

Furthermore, it has heretofore been arranged that the mounting of such a battery terminal is completed by turning the cam lever 32 laterally toward the electric-wire-connecting side and as the cam lever 32 is turned laterally during the pressing operation, it has been difficult to install any obstructing thing near the battery terminal. In other words, even in a case where a ring terminal (so-called LA terminal) is used to connect a battery cable to the battery terminal, it has also been difficult to fit a stud bolt for connecting the ring terminal to the portion nearby. Although placing the stud bolt like that is technically possible, the cam lever may not be turned laterally up to the horizontal position and this may result in a poor cam lever settlement.

As disclosed in Japanese Utility Model Publication No. 64-29784U, for example, there is another related battery terminal detachable from a battery post by pivoting an operating lever. FIG. 18 shows the construction of the battery terminal described in the above publication. The battery terminal 130 is formed with a cam lever (an operating lever) 132 that is pivotally fitted to a terminal body 131 comprising a C-shaped adaptor fitting portion 133 and a pair of folded-back pieces 134 and 135 extending in parallel to each other from both the respective ends of the C-shaped adaptor fitting portion 133. A pivotal shaft 136 is fitted to the pair of folded-back pieces 134 and 135, the cam lever 132 being pivotally supported by the pivotal shaft 136. Electric wires W are connected to one folded-back piece 134.

The operation will be described with reference to FIGS. 20A and 20B. While the cam lever 132 is uprighted as shown in FIG. 20A, the cam portion 132*a* of the cam lever 132 is also kept upright and the caliber of the adaptor fitting portion 133 of the battery terminal 130 grows large. Consequently, a battery post 140 can easily be fitted into the adaptor fitting portion 133 in the above condition.

The operation will be described with reference to FIGS. 20A and 20B. While the cam lever 132 is uprighted as shown in FIG. 20A, the cam portion 32*a* of the cam lever 132 is also kept upright and the caliber of the adaptor fitting portion 133 of the battery terminal 130 grows large. Consequently, a battery post 140 can easily be fitted into the adaptor fitting portion 133 in the above condition.

After the battery post 140 is fitted into the adaptor fitting portion 133, the cam lever 132 is turned laterally toward the pair of folded-back pieces 134 and 135 as shown in FIG. 20B whereby to make the cam portion 32*a* press the peripheral face of the battery post 140. Then a counterforce resulting from the pressing force of the cam portion 132*a* causes the inner peripheral face of the adaptor fitting portion 133 of the battery terminal 130 to be pressed against the peripheral face of the battery post 140. Consequently, the frictional force between the inner peripheral face of the adaptor fitting portion 133 and the outer peripheral face of the battery post 140 connects the battery terminal 130 to the battery post 140 electrically and mechanically.

In case where the cam lever 132 is uprighted in the above condition, on the other hand, the battery terminal 130 can be removed from battery post 140 in one touching because the pressing force of the cam portion 32*a* toward the battery post 140 is released.

Therefore, with this battery terminal 130, the battery terminal 130 can easily be attached to and detached from the battery post 140 through the operation of uprighting and turning the cam lever 132 laterally in one touching.

However, because a dimension X between outer faces of the folded-back pieces 134 and 135 for pivotally supporting the cam lever 132 is considerably smaller than a dimension D between outer side faces the adaptor fitting portion 133 due to the C-shaped configuration, the modulus of the moment of inertia to the lateral bending and the modulus of section are low and the problem is that the rigidity and strength of the battery terminal are low.

Furthermore, a problem with the battery terminal 130 is poor workability because it lacks a mechanism for holding the cam lever 132 in the upright or lateral position.

In other words, the absence of the mechanism for securely holding the cam lever 132 in the preceding upright position permits the cam lever 132 to freely pivot because of gravity, vibration or the like and this will result in poor workability in that when the cam lever is fitted to the battery post 140, the cam lever 132 must be fitted thereto before being returned to the upright position again.

When the adaptor fitting portion 133 is pressed against the battery post 140 by turning the cam lever 132 laterally, the pivoting work has remained difficult because the degree of pivoting the cam lever 132 to certainly establish the contact condition has been left unknown.

As disclosed in Japanese Patent Publication No. 9-289009A, for example, there is still another related battery terminal detachable from a battery post by pivoting an operating lever.

FIG. 21 shows the construction of the battery terminal described in the above publication. The battery terminal 230 is formed with an operating lever 232 that is pivotally fitted to a terminal body 231 comprising a C-shaped adaptor fitting portion 234, a pair of bearing block holders 235 extending in parallel to each other from both the respective ends of the C-shaped adaptor fitting portion 234, and a seat portion 238 located opposite to the bearing block holders 235.

Bearing blocks 236 are respectively fitted to the pair of the bearing block holders 235, and a pivotal shaft 237 whose left half is threaded opposite to the right half is passed through and screwed into the bearing blocks 236. Further, turning the pivotal shaft 237 by the operating lever 232 causes the pair of bearing block holders 235 to come close to or separate from each other whereby to contract or expand the diameter of the C-shaped adaptor fitting portion 234 so that a battery post 240 can be attached to or detached from the adaptor fitting portion 234.

The terminal body 231 of the battery terminal 230 is formed by bending one sheet of metal plate as shown in FIG. 22, the pair of bearing block holders 235 is formed on one side with the central adaptor fitting portion 234 held therebetween and the stud seat portion 238 on the other side via a coupling portion 239.

Therefore, the developed shape of a metal plate to be manufactured is substantially T-shaped as shown in FIG. 23. Each portion marked with an additional reference symbol A in FIG. 23 corresponds to an element when the terminal body 231 is manufactured.

In this case, as the stud seat portion 238 is formed by bending one sheet of linear belt-like plate (a portion indicated by 238A and 239A) corresponding to the T-shaped vertical rod, the length of the belt-like plate of that portion tends to become longer and the problem is that because the dimension of the overall punching area needs increasing, the yield rate is worsened and this will result in an increase in costs.

As the section of the coupling portion 239 for coupling the seat portion 238 and the adaptor fitting portion 234 together is of one-sheet structure whose vertical dimension M is small and horizontal dimension N is large as shown in FIG. 24, the modulus of the moment of inertia to the lateral bending and the modulus of section are low and the problem is that the rigidity and strength of the battery terminal are also low when the vertical bending is taken into consideration.

SUMMARY OF THE INVENTION

It is therefore a first object of the present invention is to provide a battery post adaptor designed to make itself and a battery terminal to be fitted thereto compact.

A second object of the present invention is to provide a battery terminal designed to improve contact reliability with the least lever operating force without the deformation of a battery post or a cam portion.

A third object of the present invention is to provide a battery terminal capable of storing an operating lever in a compact form on completion of connecting operation while a battery cable is being connected to a battery terminal by using a ring terminal.

A fourth object of the present invention is to provide a battery terminal designed to increase the strength of a lever supporting portion and to improve reliability in handling.

A fifth object of the present invention made is to provide a battery terminal designed to improve installation workability.

A sixth object of the present invention is to provide a battery terminal designed to improve not only a yield rate at the time of blank layout in a case where a terminal body is made by bending one sheet of metal plate, but also the flexural rigidity of the terminal body that has been made up.

In order to achieve the above objects, according to the present invention, there is provided a battery terminal structure for connecting a terminal provided with an electric wire with a stud bolt type battery post, comprising:

an adapter, having a cylindrical body which is screwed onto the battery post, and a flange portion formed on a top portion of the cylindrical body to be clamped by a screwing tool;

a terminal body, including a substantially U-shaped adaptor fitting portion which accommodates the adapter screwed on the battery post therein, and a seat portion on which the electric wire terminal is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position; and wherein the flange portion of the adaptor is engaged with a top end face of the adapter fitting portion of the terminal body.

In this configuration, since the flange portion is not only used as a member operated when screwing but also used as a member for preventing the adaptor being slipped off the terminal body, the height dimension can be decreased because of omission of elements.

Preferably, the flange portion of the adaptor has a hexagonal shape such that a dimension between opposite faces is at least identical with an outer diameter of the cylindrical body of the adaptor.

In this configuration, the largest diameter of the adaptor can be decreased. Further, the adaptor can simply be screwed onto the battery post by an impact wrench or the like.

According to the present invention, there is also provided a battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the electric wire terminal is fixed;

a lever, including a cam portion and supported on the terminal body so as to be pivotable between a first position and a second position; and an engagement member, which provisionally retains the lever in at least one of the first position and the second position, wherein a space in which the flange portion is capable of passing through is secured inside of the adaptor fitting portion when the lever is in the first position; and wherein the cam portion is abutted against an outer periphery of the cylindrical body of the adaptor so that the adaptor is retained between the cam portion and an inner face of the adaptor fitting portion, when the lever is in the second position.

In this configuration, the installation workability can be improved.

In other words, in case where the lever can provisionally be held by the engagement member in the first position, any useless movement of the lever due to gravity, vibration or the like becomes preventable to ensure that the lever can be held in the preceding operating position without being affected by vibration and gravity, so that the fitting workability of the battery terminal can be improved.

Further, in case where the lever can provisionally be held by the engagement member in the second position, the completion of the pivotal operation of the lever can be decided by the touch of the provisionally holding operation. Therefore, even though the installation work is done without paying any special attention to the predetermined position in which the lever can be stopped. Thus the fitting workability becomes improvable. Moreover, the pressing force against the battery post can constantly be controlled, which also results in improving contact reliability.

Preferably, the engagement member includes a recessed portion formed on one of the terminal body and the lever, and a convex portion engaged with the recessed portion formed on the other of the terminal body and the lever.

In this configuration, in case where the operating lever is moved with force greater than the predetermined degree, the provisional holding resulting from the engagement between the convex and recessed portions is released and the operating lever is freely made pivotal. Moreover, clicking is felt at the time of their engagement to have the provisional holding confirmed thereby.

According to the present invention, there is also provided a battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the electric wire terminal is fixed;

a lever, including a cam portion and supported on the terminal body so as to be pivotable between a first position and a second position; and an engagement member, which provisionally retains the lever in at least one of the first position and the second position, wherein a space in which the flange portion is capable of passing through is secured inside of the adaptor fitting portion when the lever is in the first position; and wherein the cam portion is abutted against an outer periphery of the cylindrical body of the adaptor so that the adaptor is retained between the cam portion and an inner face of the adaptor fitting portion, when the lever is in the second position.

In this configuration, since the overlap margin at the time the cam portion is pressed against the battery post adaptor is absorbed by the elastic member, force to be applied when the lever is pivoted can be minimized. Moreover, unnatural force is prevented from being applied to the peripheral face of the battery post adaptor and the battery terminal itself. The contact load is also stabilized and contact reliability is improved as the press-contact force of the cam portion against the adaptor is determined by the elastic force of the elastic member.

Preferably, the elastic member is a plate spring which constitutes the cam portion of the lever.

In this configuration, the battery terminal can be made simple in construction as compared with a case where the elastic member is provided in any other portion.

Here, it is preferable that the plate spring is extended along an outer periphery of the cam portion such that a first end portion of the plate spring is fixed on the lever member and a second end portion of the plate spring is movable retained at the cam portion.

In this configuration, the plate spring is easily subjected to flexural deformation, so that a good elastic contact function can be fulfilled for the battery post adaptor.

According to the present invention, there is also provided a battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the electric wire terminal is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position;

wherein the terminal body is made of a single metal plate including a first portion which is bent in a thickness direction thereof to form the adaptor fitting portion, a second portion extended perpendicularly from a first end of the first portion, and a third portion extended perpendicularly from a second end of the first portion; and wherein the second and third portions are bent so as to be overlapped with each other to form the seat portion.

In this configuration, the dimensions of the developed metal plate become reducible, whereby the yield rate of obtaining the plates can be improved when blanking operation is executed.

Furthermore, since the seat portion is formed with the two sheets of plates, the rigidity and strength thereof is increased.

Preferably, the electric wire terminal is fixed on the seat portion with a stud bolt inserted through a through hole formed in the seat portion and a nut screwed onto the stud bolt. Here, a retaining piece is integrally formed on either one of the second and third portions of the metal plate. The retaining piece is bent to form a retaining member which retains a head portion of the stud bolt.

In this configuration, the stud bolt can be prevented from slipping out by the retaining member of the battery terminal.

According to the present invention, there is also provided a battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the electric wire terminal is fixed;

a lever, including a cam portion and supported on the terminal body so as to be pivotable between a first position and a second position; and an elastic member provided in either one of the lever or the terminal body for bringing the cam portion into an elastic contact with the adaptor, wherein a space in which the flange portion is capable of passing through is secured inside of the adaptor fitting portion when the lever is in the first position; and wherein the cam portion is abutted against an outer periphery of the cylindrical body of the adaptor so that the adaptor is retained between the cam portion and an inner face of the adaptor fitting portion, when the lever is in the second position.

In this configuration, the modulus of the moment of inertia to the lateral bending and the modulus of section can be increased, so that the strength of the relevant portion can also be raised.

According to the present invention, there is also provided a battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool, a terminal body, including a substantially U-shaped adaptor fitting portion which accommodates the adapter screwed on the battery post therein, and a seat portion on which the electric wire terminal is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position;

wherein the electric wire terminal is fixed on the seat portion with a stud bolt and a nut; and wherein the lever includes a through hole which accommodates the nut therein when the lever is in the second position.

In this configuration, since the through hole for the purpose of avoiding the interference of the nut and the lever, the battery terminal can be made compact.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
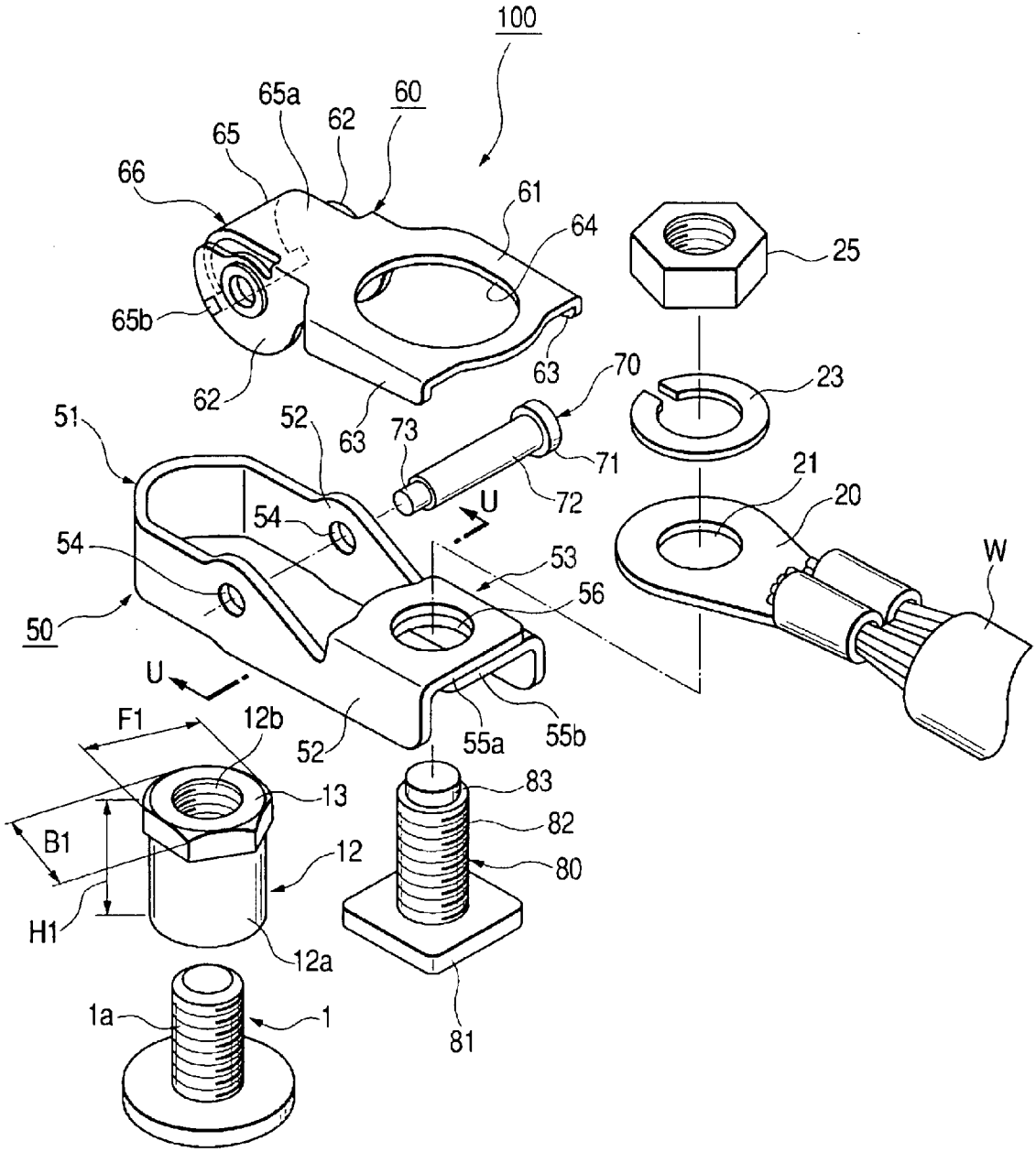
FIG. 1 is an exploded perspective view showing the relation between a battery post adaptor and a battery terminal, according to a first embodiment of the invention.

A first embodiment of the present invention will now be described with reference to the accompanying drawings.

A battery terminal 100 is fitted to a stud bolt type battery post 1, and a tubular battery post adaptor 12 for fitting up the battery terminal 100 is mounted on the battery post 1.

The battery post adaptor 12 has a tubular terminal mounting portion 12*a* having an internal thread 12*b* to be screwed onto the external thread 1*a* of the battery post 1, and a hexagonal portion (flange portion) 13 integrally formed with the upper end of the tubular terminal mounting portion 12*a*.

The hexagonal portion 13 is a portion for fitting an adaptor fastening tool (e.g., an impact wrench) therein and this portion is simultaneously used as a flange portion for preventing the battery terminal from slipping out. Therefore, by mating the impact wrench with the hexagonal portion 13, the battery post adaptor 12 can be fixedly fastened to the battery post 1. When the battery terminal 100 is pressed against the battery post adaptor 12, the battery terminal 100 can be prevented from slipping out as the hexagonal portion 13 serves as the flange portion. Consequently, a face-to-face dimension B1 of the hexagonal portion 13 is set at least greater than the outer diameter of the terminal mounting portion 12*a*.

In order to make the battery post adaptor 12 as small in size as possible according to this embodiment of the invention, the face-to-face dimension B1 of the hexagonal portion 13 is set equal to or slightly greater than the outer diameter of the tubular terminal mounting portion 12*a*, so that an apex-to-apex dimension F1, which is the largest diameter portion, is become as small as possible. Further, since the hexagonal portion 13 serves as also the flange portion, the dimension thereof in its direction of height can be made compact.

The battery terminal 100 electrically connected to the battery post adaptor 12, includes a terminal body 50 made by press-bending one sheet of metal plate, an operating lever 60 similarly made by press-bending one sheet of metal plate, a pivotal shaft 70, and a stud bolt 80.

The stud bolt 80 is provided for mounting a ring terminal 20 attached to a leading end of a battery cable W on the battery terminal 100 using a washer 23 and a nut 25.

A curved adaptor fitting portion 51 is provided on one side of the terminal body 50 for receiving the battery post adaptor 12 therein. A fitting seat 53 of the stud bolt 80 is provided on the other side of the terminal body 50 for receiving the ring terminal 20.

To form the terminal body 50 as an integral product, one sheet of belt-like metal plate is first bent to form the U-shaped adaptor fitting portion 51. At both ends of side plates 52 thus formed, rectangular pieces 55*a* and 55*b* are integrally formed, respectively. The rectangular pieces 55*a* and 55*b* are bent inward so as to be overlapped with each other to form the seat portion 53. A through hole 56, into which the stud bolt 80 is inserted, is formed at the seat portion 53.

Figure 7:
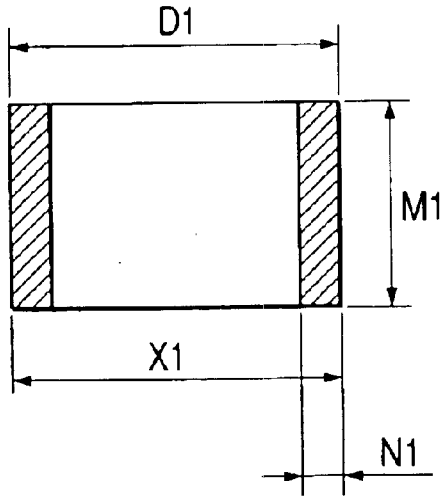
FIG. 7 is a sectional view taken along a line U—U of FIG. 1.

In this case, the two sheets of side plates 52 are extended in parallel in the extending directions of both ends of the U-shaped adaptor fitting portion 51, and a dimension X1 between outer faces of the side plates 52 is set equal to a dimension D1 between outer side faces of the adaptor fitting portion 51 as shown in FIG. 7.

Further, the base of the operating lever 60 is inserted in between the two sheets of side plates 52 connecting the adaptor fitting portion 51 and the seat portion 53.

The operating lever 60 is provided with a substantially rectangular top face 61, a pair of substantially circular side plates 62 and a curved plate spring 65 extended to the front end of the top face 61.

A through hole 64 is formed in the central portion of the top face 61 in order to prevent the operating lever 60 from interfering with the nut 25 securely fastened to the stud bolt 80, which will be described later, when the operating lever 60 is turned laterally onto the seat portion 53. Moreover, reinforcing ribs 63 bent downward are provided to both the respective left and right side edges of the top face 61.

The side plates 62 are placed wide enough to be fitted in between both the side plates 52 of the terminal body 50, and both the ends of the pivotal shaft 70 passed through these side plates 62 are supported by the shaft holes 54 of both the side plates 52 of the terminal body 50, whereby the operating lever 60 is vertically pivotally mounted onto the terminal body 50.

The pivotal shaft 70 is formed by extending its body portion 72 passing through the side plates 62 of the operating lever 60 from a flange-like head portion 71 together with a small-diameter shaft portion 73 at the front end thereof, so that the pivotal shaft 70 is prevented from slipping out by securing the small-diameter shaft portion 73 at the front end to the shaft hole 54 of one side plate 52.

The plate spring 65 extended to the front end of the top face 61 is curved into a substantially arcuate profile whereby to form a cam portion 66 for elastically pressing the peripheral face of the battery post adaptor 12. As shown in FIG. 2B, the distance (radius) from the center of the pivotal shaft 70 up to the outer peripheral face (cam face) of the cam portion 66 is gently varied such that the smallest diameter portion of the curved face is directed toward the adaptor fitting portion 51 when the operating lever 60 is uprighted and the largest diameter portion of the curved face is directed toward the adaptor fitting portion 51 when the operating lever 60 is turned laterally toward the seat portion 53 by 90 degrees (see FIG. 3B).

As shown in FIG. 2B, a radius R2 in the largest diameter portion is set greater than the greatest distance R1 from the center of the pivotal shaft 70 with the battery post adaptor 12 fitted into the adaptor fitting portion 51 up to the outer periphery of the battery post adaptor 12. In other words, a predetermined deformation margin δ2 (overlap margin) is provided to the plate spring 65 forming the cam portion 66 when the outer peripheral face of the battery post adaptor 12 is properly pressed down with the largest diameter portion having the radius R2 by turning the operating lever 60 laterally as shown in FIG. 3B. Here, FIG. 3B shows a state in which the plate spring 65 has not been deformed so as to indicate the presence of the deformation margin δ2.

The plate spring 65 is disposed along the peripheral face of the cam portion 66. A base portion 65*a* of the plate spring 65 is coupled to the top face 61 to be fixedly supported, and a T-shaped front end portion 65*b* is movably retained by the side plate 62. Further, the profile of the cam portion 66 is determined so that the central position of the plate spring 65 in its peripheral direction (longitudinal direction) may become the largest diameter portion. In this case, the plate spring 65 is free from the side plates 62 and capable of bending and deforming independent of the side plates 62.

The stud bolt 80 is inserted upward from the underside of the seat portion 53. The stud bolt 80 is provided with a rectangular plate-like head portion 81 and a threaded shaft portion 82, the front end 83 of the threaded shaft portion 82 having a slightly small diameter so as to mate the ring terminal 20 and the nut 25 therewith.

Upon the insertion of the stud bolt 80 upward from below, the rectangular head portion 81 of the stud bolt 80 is fitted in between the side plates 52 beneath the seat portion 53 and prevented from turning. In this state, moreover, the head portion 81 of the stud bolt 80 is retained by bending a pawl portion 58 formed on the rectangular plate 55*b* making up the seat portion 53, whereby the stud bolt 80 is prevented from slipping downward.

The fitting operation will now be described.

As shown in FIG. 1, the battery cable W is connected to the battery terminal 100 by fitting the stud bolt 80 projecting upward in the end portion of the terminal body 50 into the ring terminal 20 attached to the battery cable W, and then securely fastening the nut 25 to the screw shaft portion 82 of the stud bolt 80 via the washer 23.

Figure 2A:
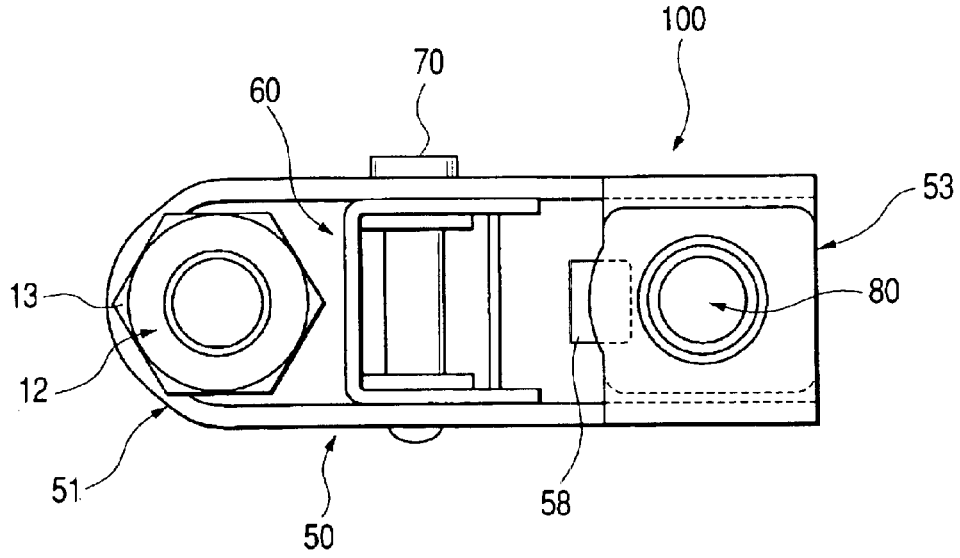
FIG. 2A is a plan view showing a state in which the battery terminal is simply set to the battery post adaptor of FIG. 1.
Figure 2B:
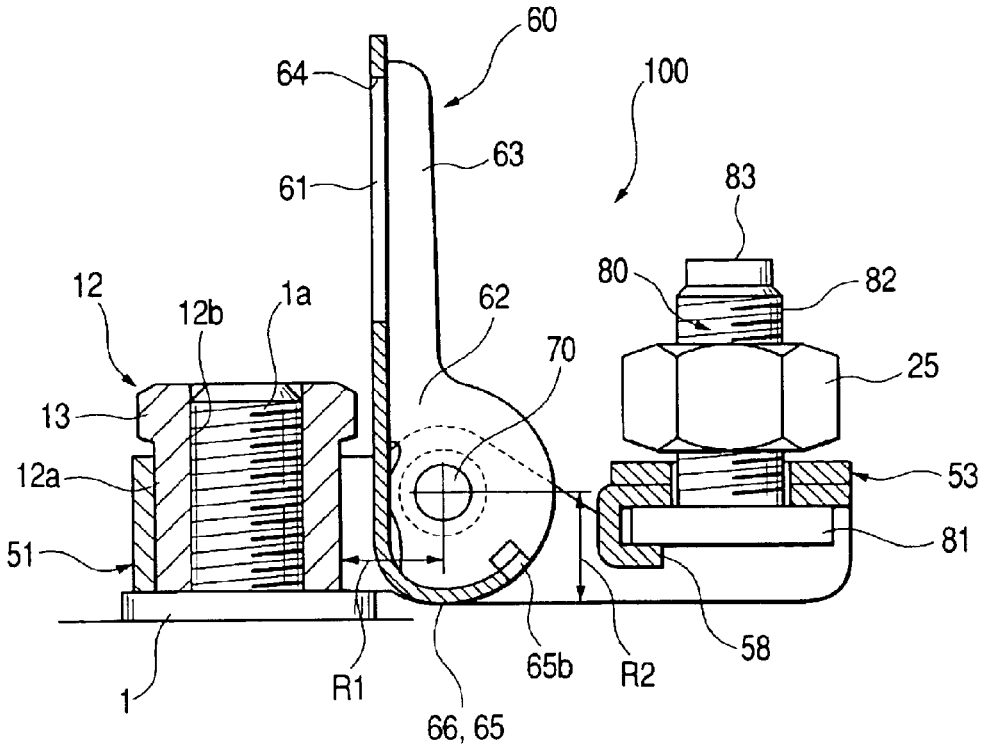
FIG. 2B is a sectional side view of FIG. 2A.
Figure 3A:
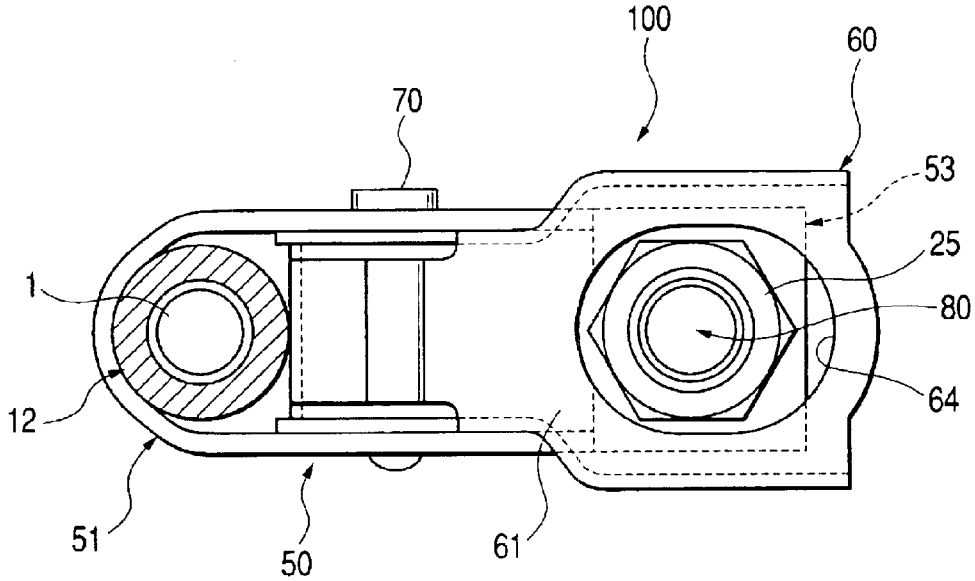
FIG. 3A is a plan view showing a state in which an adaptor fitting portion of the battery terminal is pressed against the battery post adaptor by pivoting an operating lever.
Figure 3B:
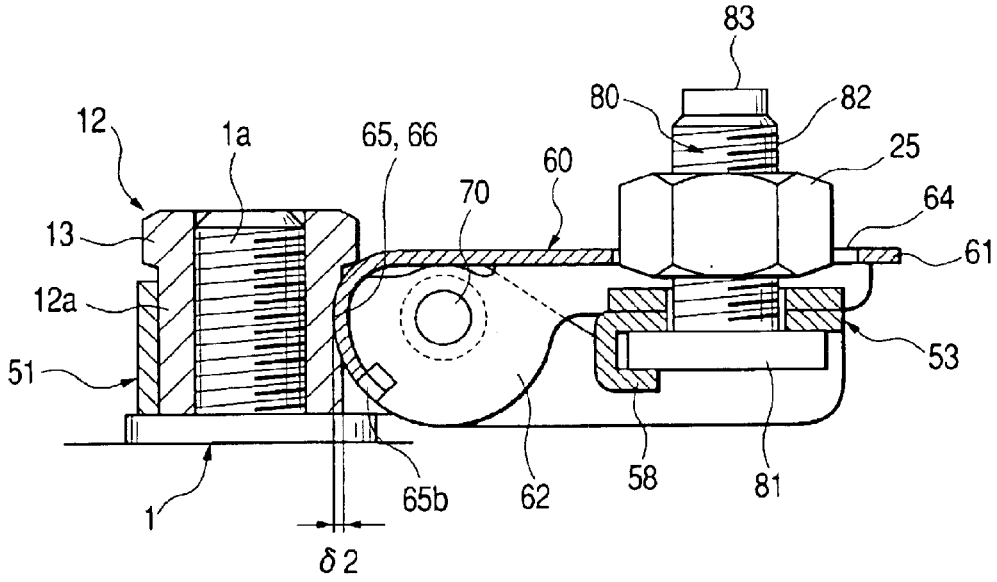
FIG. 3B is a sectional side view of FIG. 3A.
Figure 4:
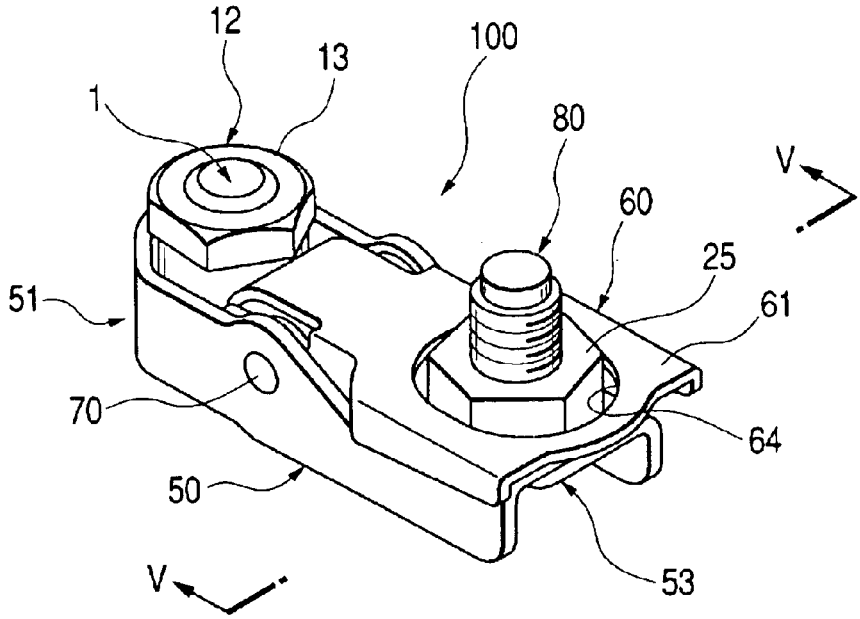
FIG. 4 is a perspective view of FIG. 3A.
Figure 5:
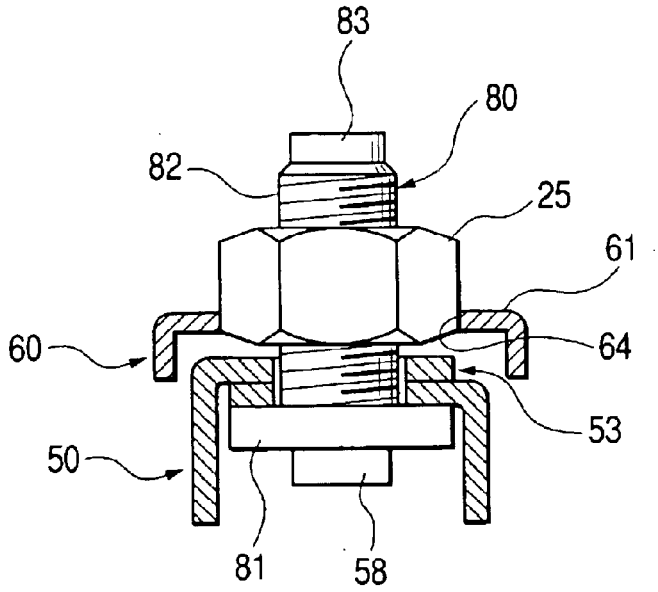
FIG. 5 is a sectional view taken along a line V—V of FIG. 4.

As the smallest diameter portion of the cam portion 66 is directed toward the adaptor fitting portion 51 in the upright condition of the operating lever 60 as shown in FIGS. 2A and 2B, the caliber of the adaptor fitting portion 51 is kept large. Therefore, the battery post adaptor 12 can easily be received into the adaptor fitting portion 51 of the battery terminal 100.

After the battery post adaptor 12 is received into the adaptor fitting portion 51, the operating lever 60 is pivoted by 90 degrees in the above condition and then turned laterally onto the seat portion 53 as shown in FIGS. 3A to 5. When the operating lever 60 is thus turned downward, the largest diameter portion of the cam portion 66 of the operating lever 60 is brought into press-contact with the outer peripheral face of the battery post adaptor 12. Then the counterforce resulting from the pressing force causes the inner peripheral face of the adaptor fitting portion 51 to be pressed against the outer periphery of the terminal mounting portion 12*a* of the battery post adaptor 12, so that the battery terminal 100 and the battery post 1 are electrically and mechanically connected. In the above state, the battery terminal 100 is never slipped out as the hexagonal portion 13 used also as the flange portion is located at the upper end of the battery post adaptor 12.

Further, the presence of the through hole 64 for avoiding the interference of the nut 25 in the top face 61 of the operating lever 60 makes it possible to completely turn the operating lever 60 laterally up to the position where the operating lever 60 lies on top of the seat portion 53, and the battery terminal 100 can be made as compact as possible in the above press-contact condition.

When the battery terminal 100 is removed therefrom in the above condition, the operating lever 60 is uprighted up to the state of FIGS. 2A and 2B. Then the pressing force of the cam portion 66 is released and the caliber of the adaptor fitting portion 51 is expanded, whereby the battery terminal 100 can easily be removed from the battery post adaptor 12.

Moreover, the battery terminal 100 according to this embodiment has the following advantages.

First, as the cam portion 66 of the battery terminal 100 is formed with the plate spring 65, the lap margin δ2 can be absorbed by the elastic deformation of the plate spring 65 when the cam portion 66 is pressed against the battery post adaptor 12.

Therefore, force to be applied when the operating lever 60 is pivoted can thus be minimized and besides unnatural force is prevented from being applied to the peripheral face of the battery post adaptor 12 and the battery terminal 100. Consequently, the deformation of the battery post adaptor 12 and the battery terminal 100 is preventable. Moreover, the contact load is stabilized and contact reliability is improved as the press-contact force of the cam portion 66 against the battery post adaptor 12 is determined by the elastic force.

Although the provision of a spring as a member to make the cam portion 66 elastically contact the battery post adaptor 12 is possible in any portion, the construction of the above battery terminal 100 can be simplified by forming the cam portion 66 itself with the plate spring 65.

Further, since one end (the front end portion 65*b*) of the plate spring 65 forming the cam portion 66 is movably supported, the plate spring 65 is readily subjected to bending deformation, whereby a good elastic contact function can be fulfilled for the battery post adaptor 12.

Figure 6:
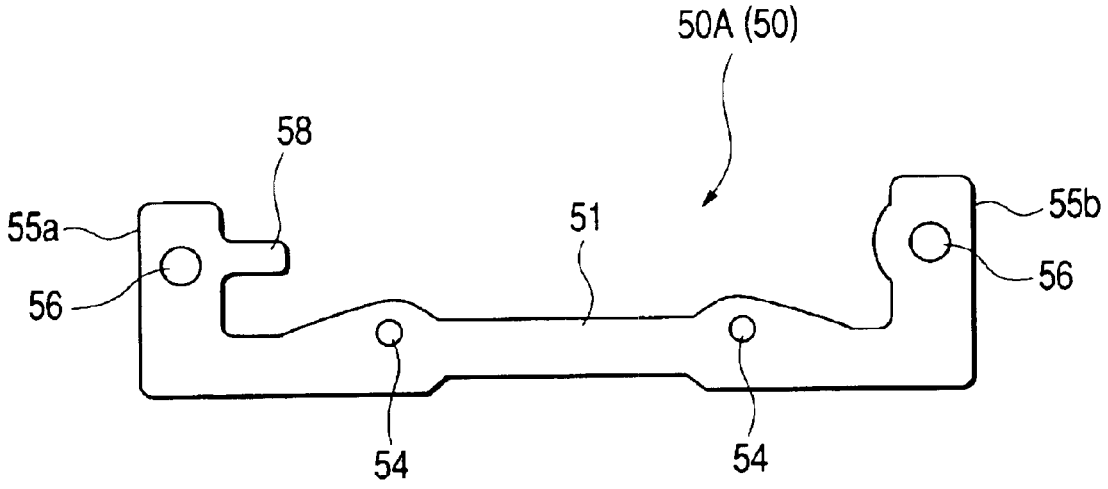
FIG. 6 is a developed view of a terminal body in the battery terminal.

As shown in FIG. 6, a metal plate 50A forming the terminal body 50 may be in a U-shaped developed form with the rectangular pieces 55*a* and 55*b* formed on the respective side edges of belt-like plates in the battery terminal 100. Further, by bending the rectangular pieces 55*a* and 55*b* inward from both sides and overlapping both of them to form the seat portion 53 for the stud bolt 80, it is possible to set short the projected length of the rectangular pieces 55*a* and 55*b* while sufficient strength is maintained. Thus the dimensions of the developed U-shaped metal plate 50A are made smaller and the yield rate can be improved because blank layout dimensions are reducible.

As shown in FIG. 7, since the portion used to couple the seat portion 53 and the adaptor fitting portion 51 is formed with the two sheets of side plates 52 having the same thicknesses as those of the adaptor fitting portion 51, and since the vertical sectional dimension M1 of each side plate 52 is large with the horizontal sectional dimension N1 thereof being small, the modulus of the moment of inertia and the modulus of section of that coupling portion increase and the vertical and lateral flexural rigidity is raised.

Furthermore, since the dimension X1 between the outer side faces of the side plates 52 is set equal to the dimension D1 between the outer faces of the adaptor fitting portion 51, the modulus of the moment of inertia and the modulus of section of that coupling portion increase and the vertical and lateral flexural rigidity is raised, so that a battery terminal having greater strength is available.

Next, a battery terminal according to a second embodiment will be described below with reference to FIGS. 8A to 11. Elements identical with the first embodiment are designated the same reference numerals, and detailed explanations therefor are omitted here.

In a battery terminal 110, convex and recessed portions as an engagement member for provisionally holding the operating lever 60 in a predetermined position are respectively provided to the side plates 62 of the operating lever 60 and the opposing side plates 52 of the terminal body 50. In this case, the recessed portions (in the form of retaining holes according to this embodiment) 91 and 92 are formed in the side plate 52 on the terminal body side 50 so that the operating lever 60 may be provisionally and elastically held in two places including the upright position shown in FIGS. 9A and 9B and the completely turned-down position shown in FIGS. 10A and 10B where the operating lever 60 is turned down by 90 degrees. Each convex portion 93 selectively and elastically engaging with the recessed portion 91 or 92 is formed on the outer surface of the side plate 62 of the operating lever 60.

Figure 8A:
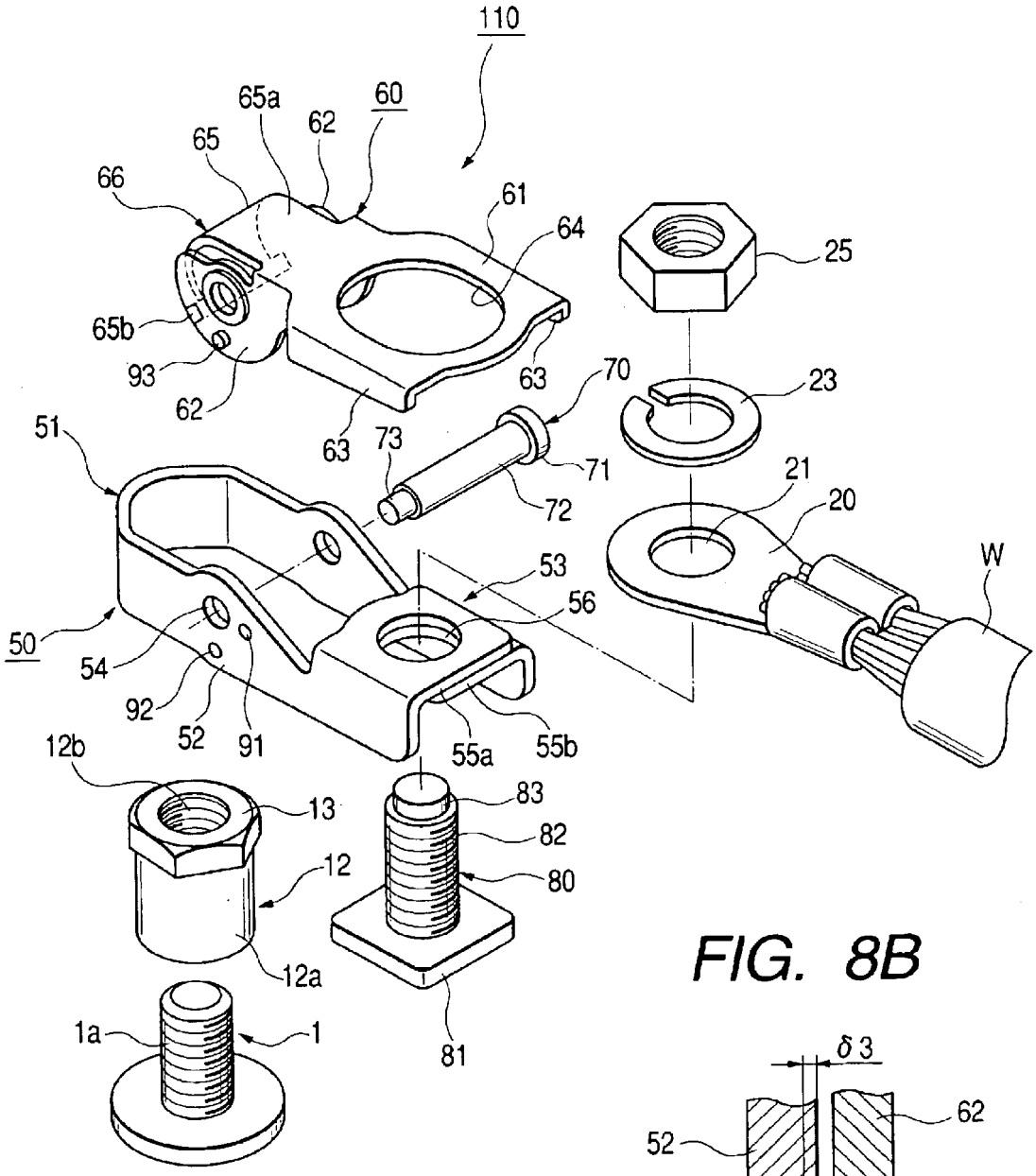
FIG. 8A is an exploded perspective view showing the relation a battery post adaptor and a battery terminal, according to a second embodiment of the invention.
Figure 8B:
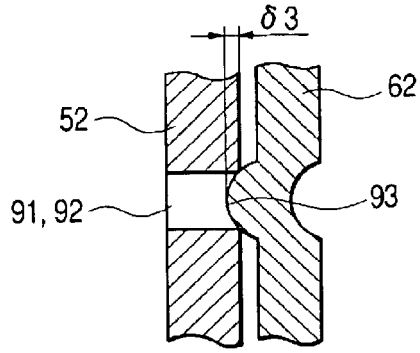
FIG. 8B is a partial enlarged sectional view of an engagement member in the battery terminal of FIG. 8A.
Figure 9A:
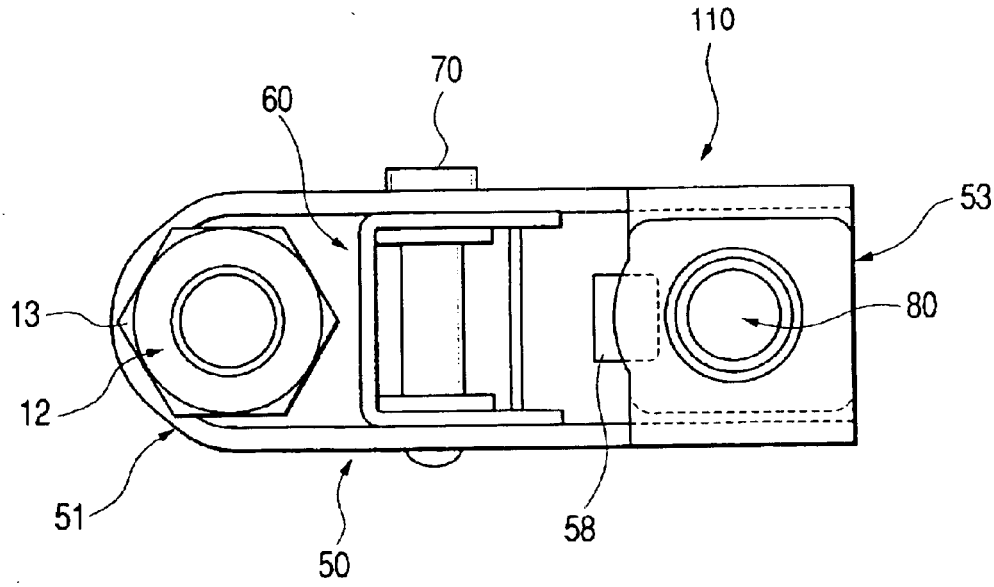
FIG. 9A is a plan view showing a state in which the battery terminal is simply set to the battery post adaptor of FIG. 8A.
Figure 9B:
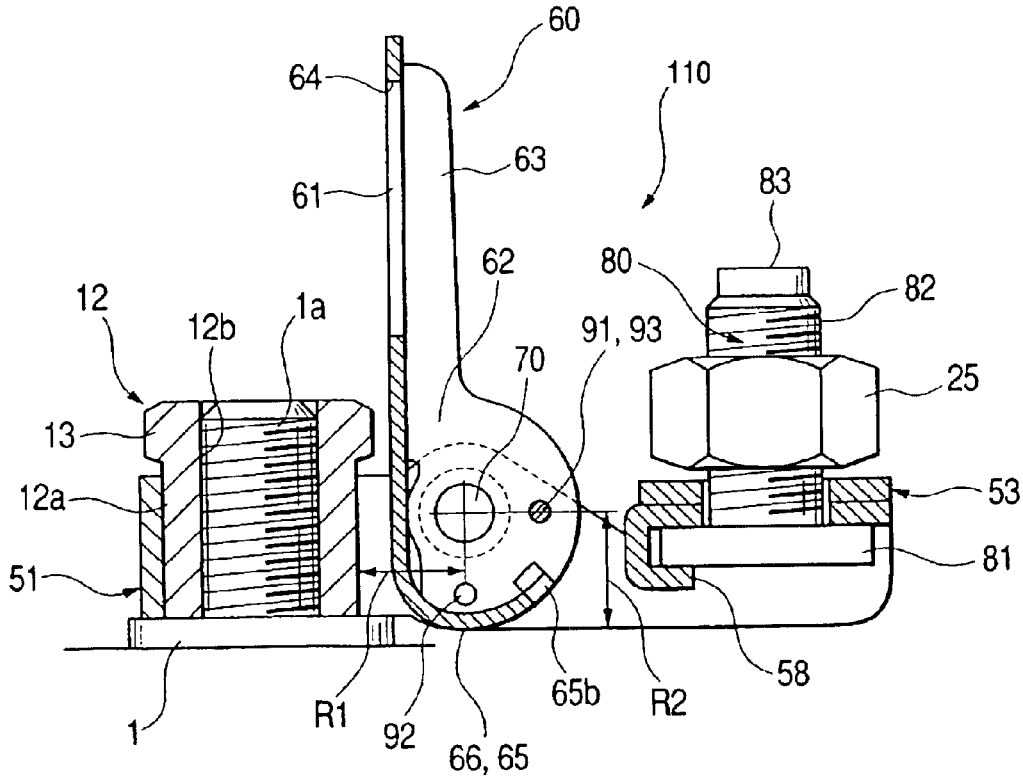
FIG. 9B is a sectional side view of FIG. 9A.
Figure 10A:
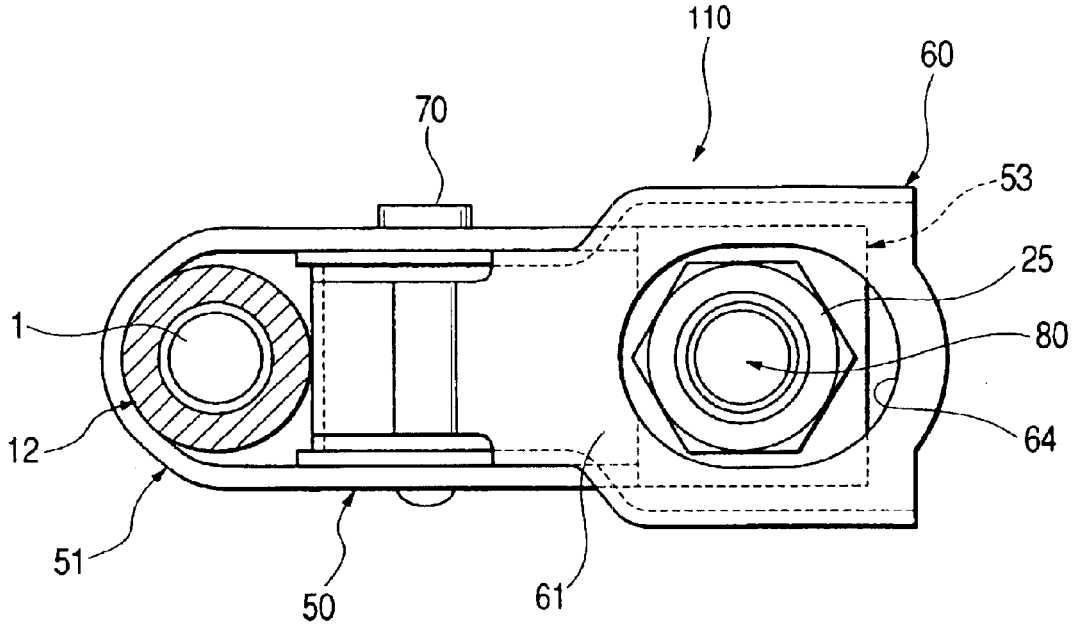
FIG. 10A is a plan view showing a state in which an adaptor fitting portion of the battery terminal is pressed against the battery post adaptor by pivoting an operating lever.
Figure 10B:
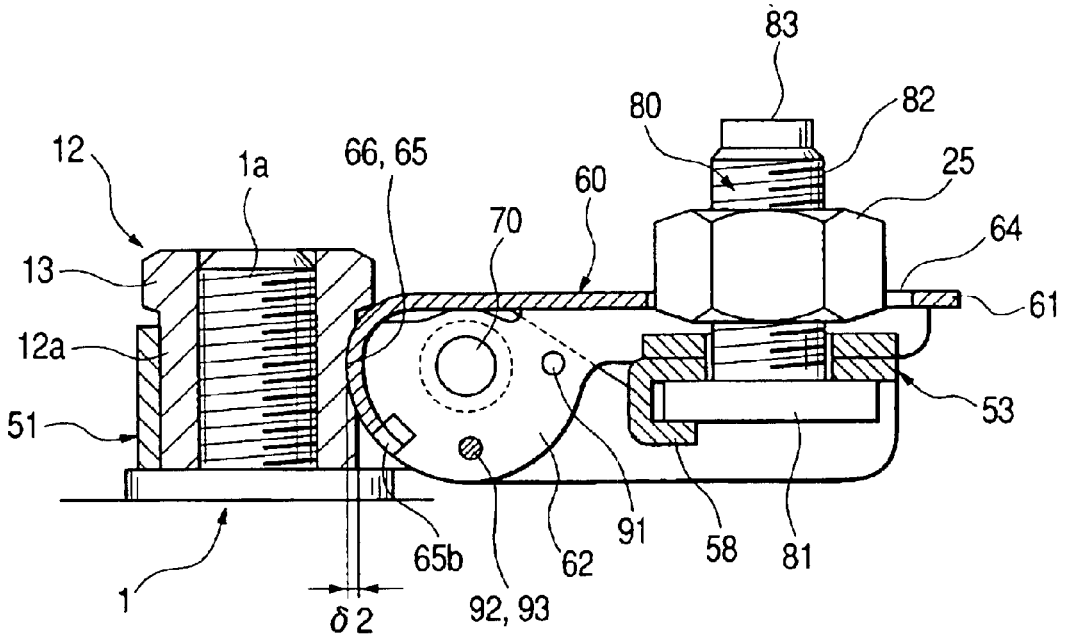
FIG. 10B is a sectional side view of FIG. 10A.
Figure 11:
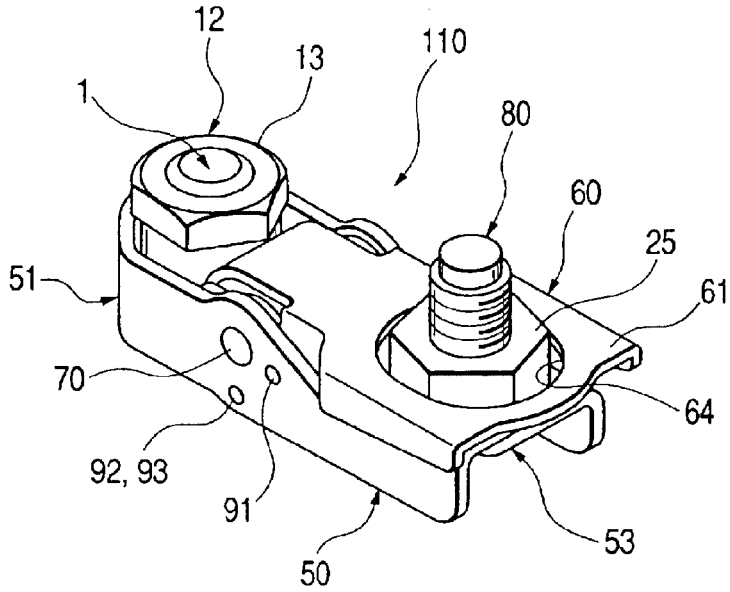
FIG. 11 PRIOR ART
FIG. 11 is a perspective view of FIG. 10A.
Figure 12:
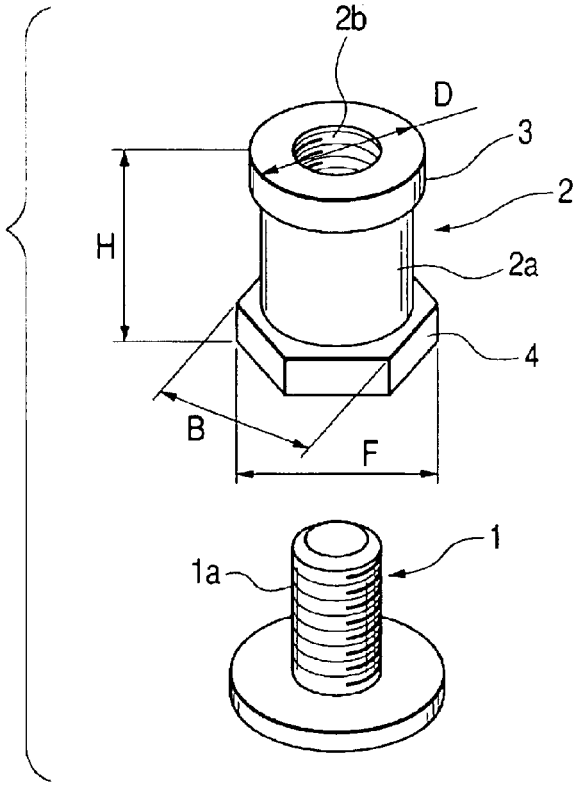
FIG. 12 RELATED ART
FIG. 12 is a perspective view of a related battery post adaptor.
Figure 13:
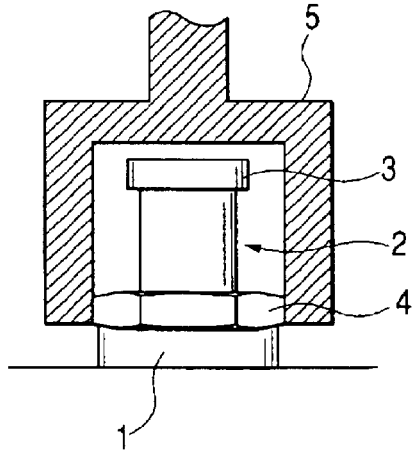
FIG. 13 RELATED ART
FIG. 13 is a sectional side view of a state in which the related battery post adaptor is fitted to a battery post using an impact wrench.
Figure 14:
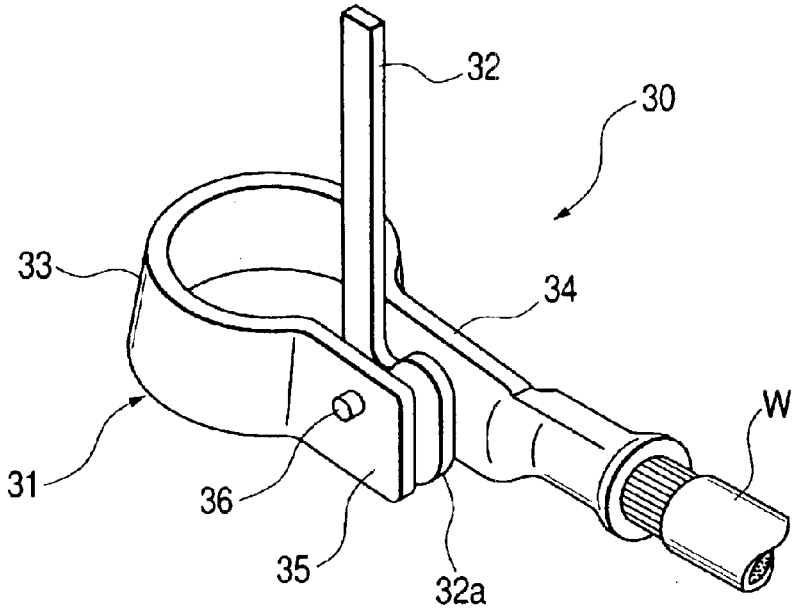
FIG. 14 PRIOR ART
FIG. 14 is a perspective view of a first related battery terminal.
Figure 15:
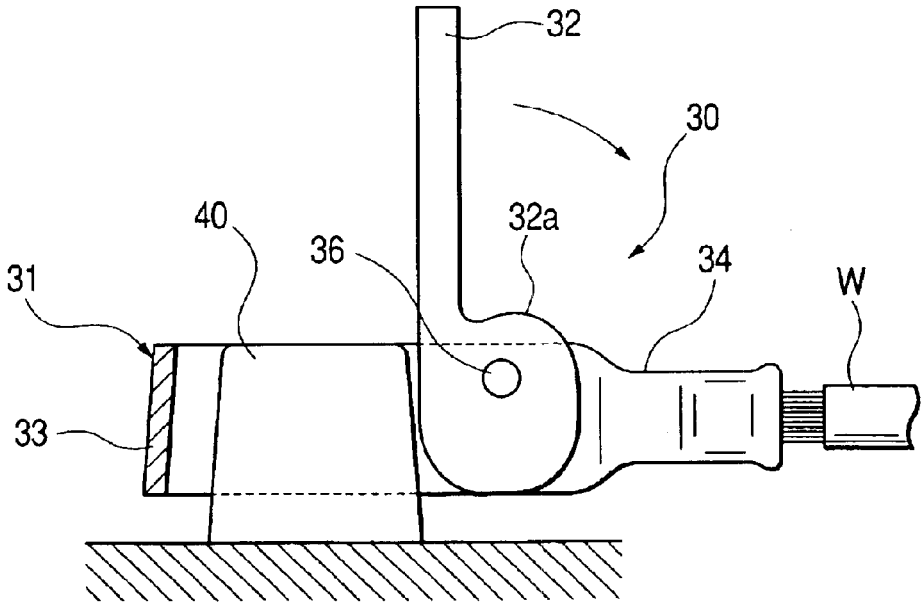
FIG. 15 PRIOR ART
FIG. 15 is a sectional side view of a state in which the battery terminal of FIG. 14 is simply set to a battery post.
Figure 16:
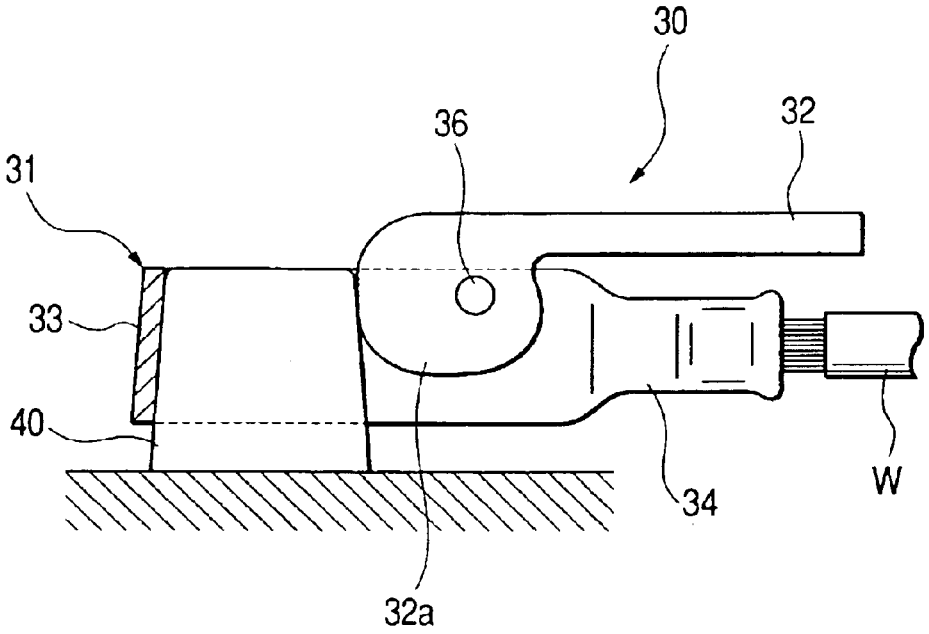
FIG. 16 PRIOR ART
FIG. 16 is a sectional side view of a state in which a cam lever is turned laterally from the state of FIG. 15, so as to press the battery terminal against the battery post.
Figure 17:
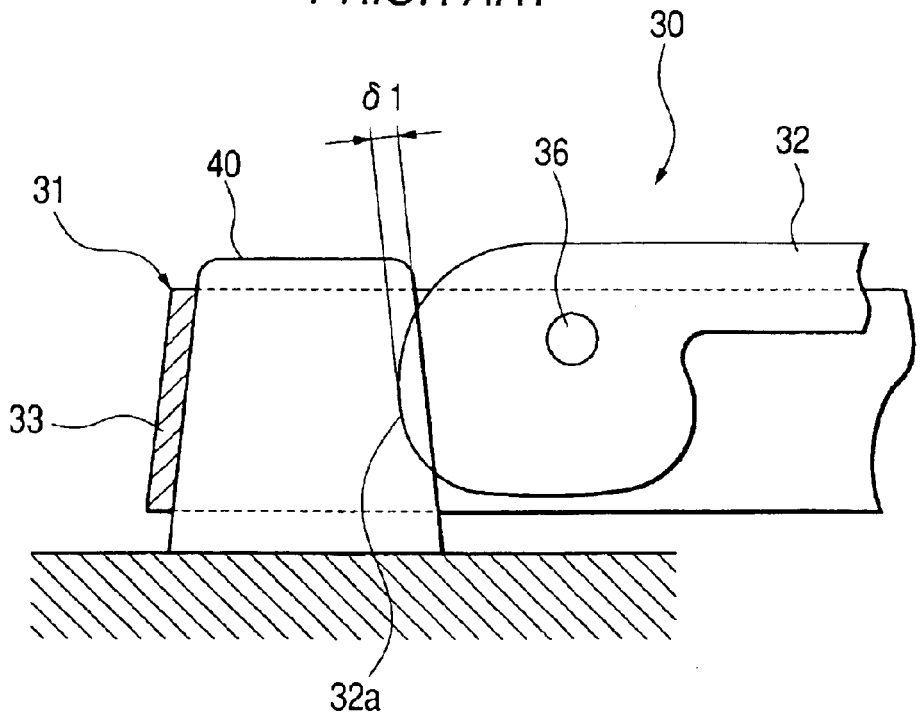
FIG. 17 PRIOR ART
FIG. 17 is an enlarged sectional side view explanatory of problems at the time of press-contacting operation of the battery terminal of FIG. 14.
Figure 18:
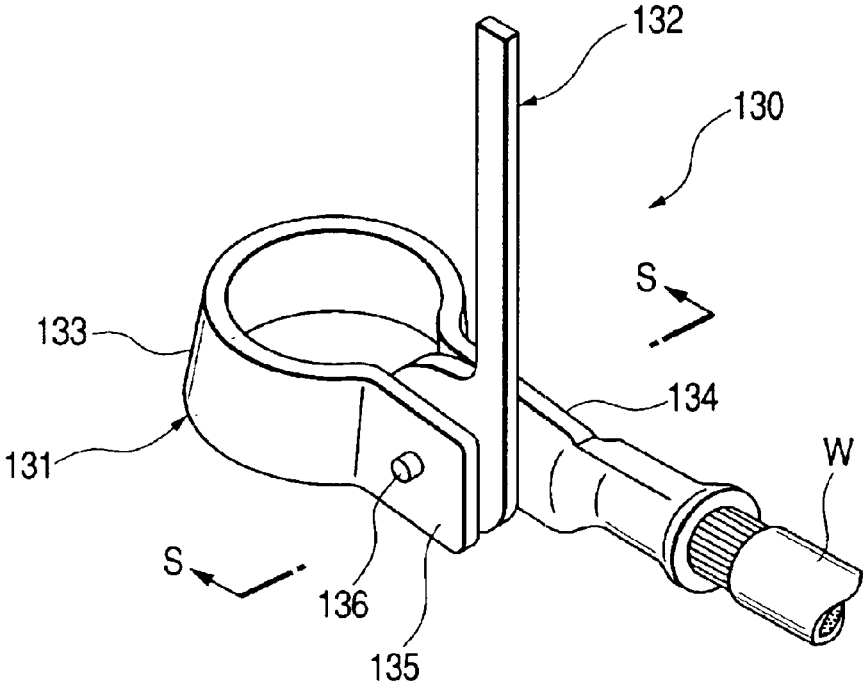
FIG. 18 PRIOR ART
FIG. 18 is a perspective view of a third related battery terminal.
Figure 19:
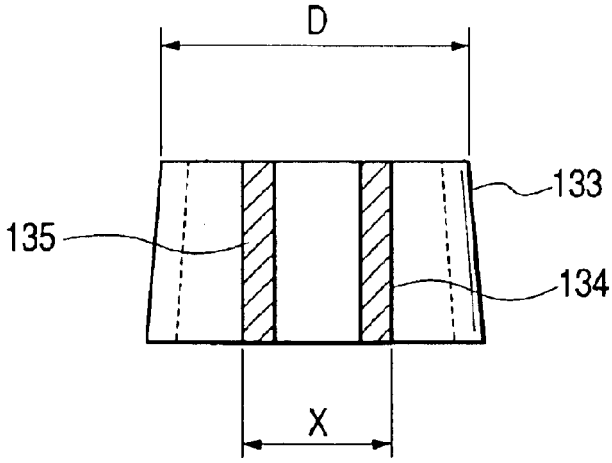
FIG. 19 PRIOR ART
FIG. 19 is a sectional view taken along a line S—S of FIG. 18.
Figure 20A:
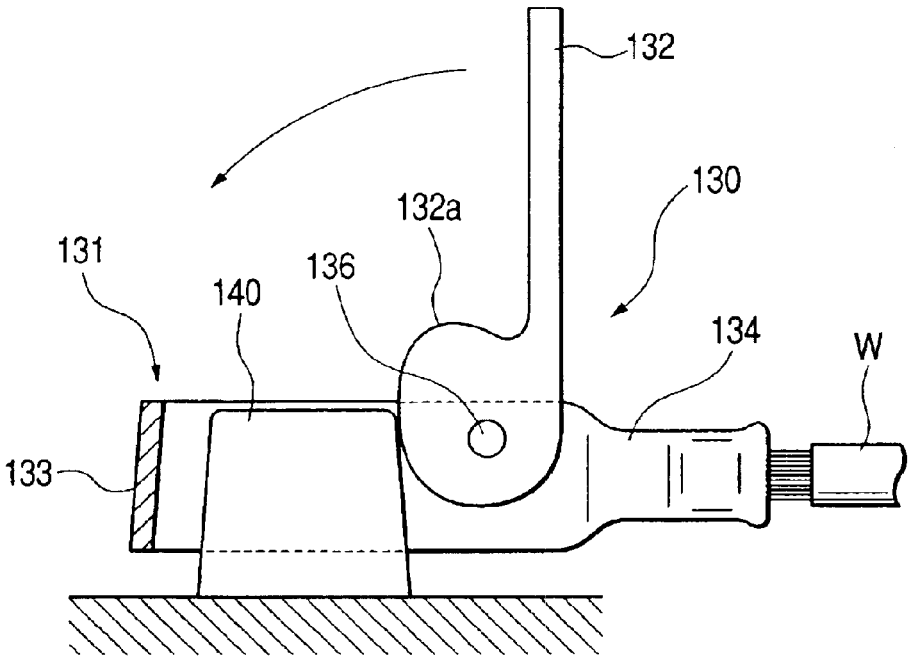
FIG. 20A PRIOR ART
FIG. 20A is a sectional side view of a state in which the battery terminal is simply set to the battery post.
Figure 20B:
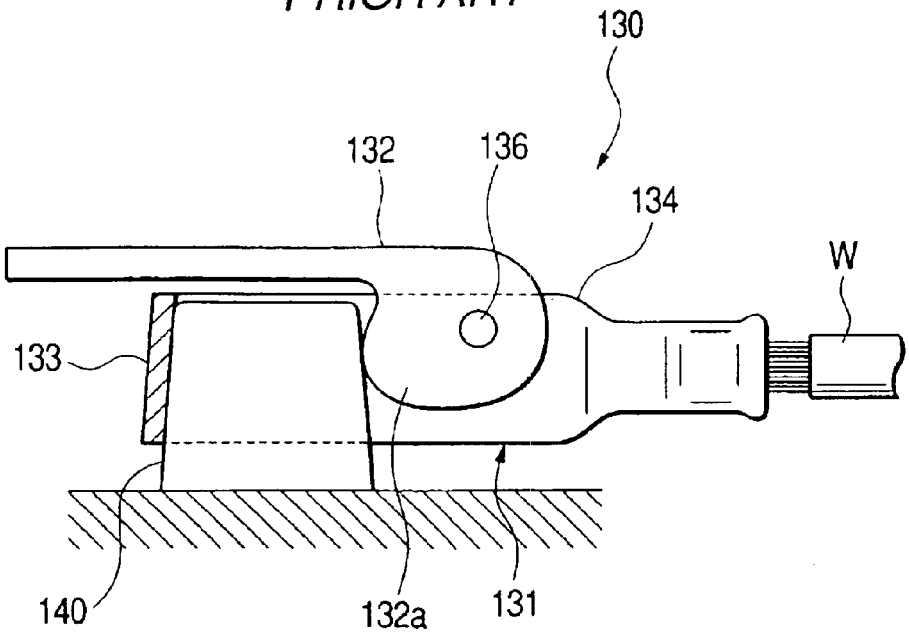
FIG. 20B PRIOR ART
FIG. 20B is a sectional side view of a state in which a cam lever is turned laterally from the state of FIG. 20A, so as to press the battery terminal against the battery post.
Figure 21:
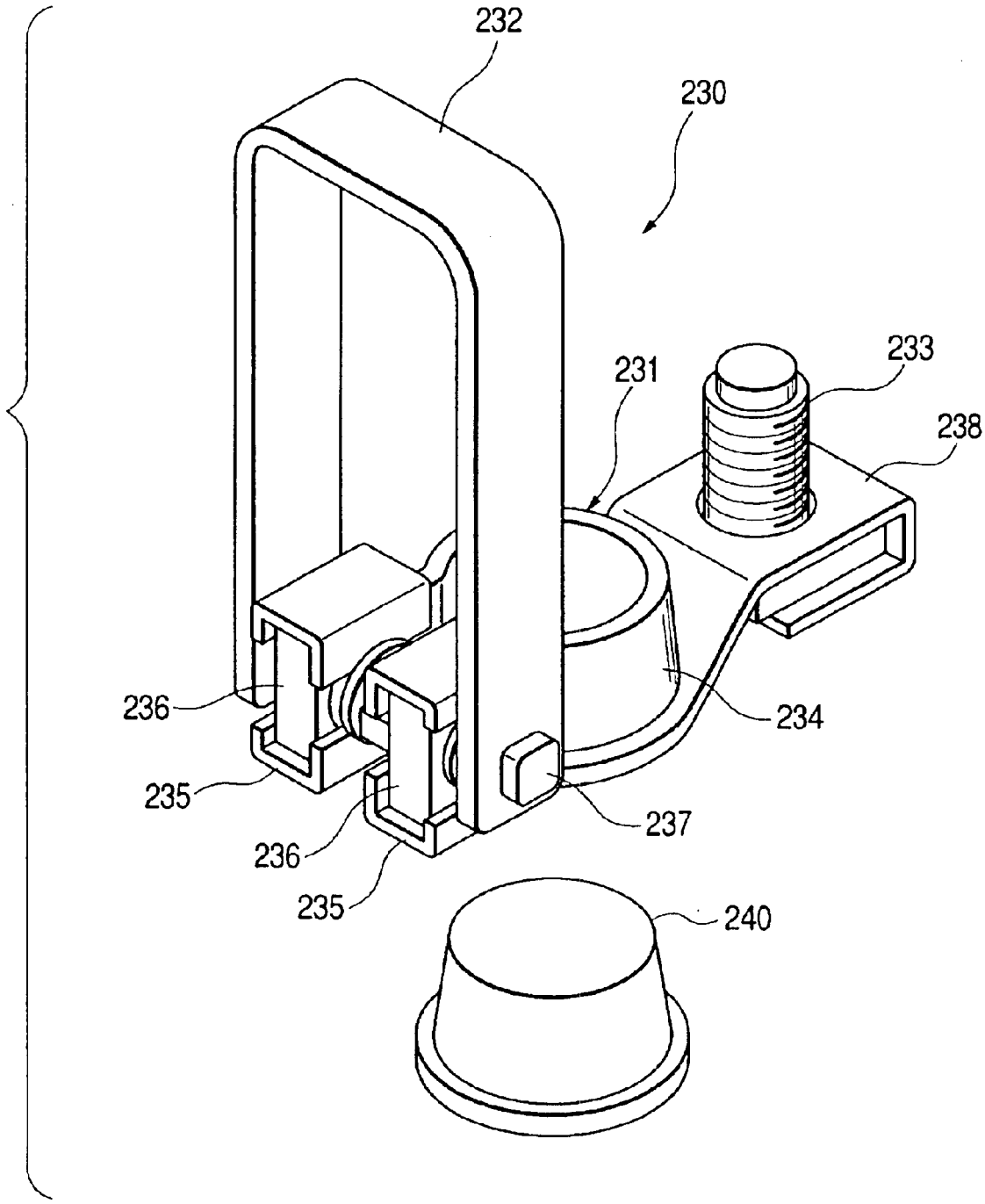
FIG. 21 PRIOR ART
FIG. 21 is a perspective view of a fourth related battery terminal.
Figure 22:
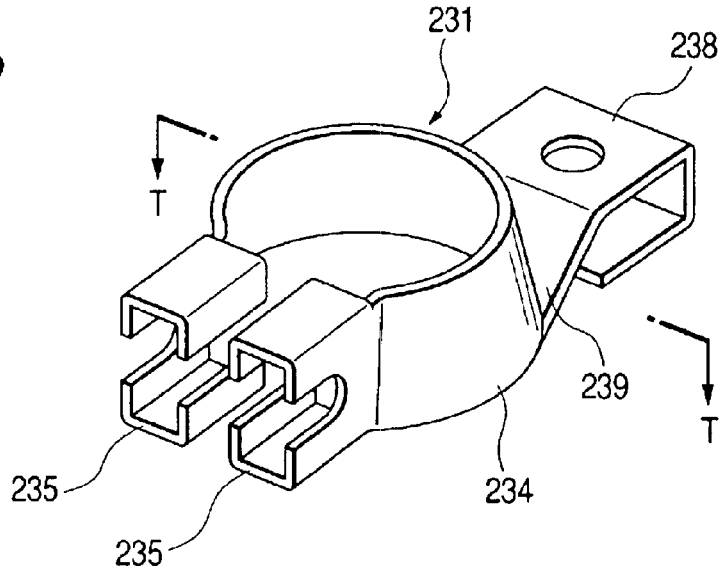
FIG. 22 PRIOR ART
FIG. 22 is a perspective view of a terminal body in the battery terminal of FIG. 21.
Figure 23:
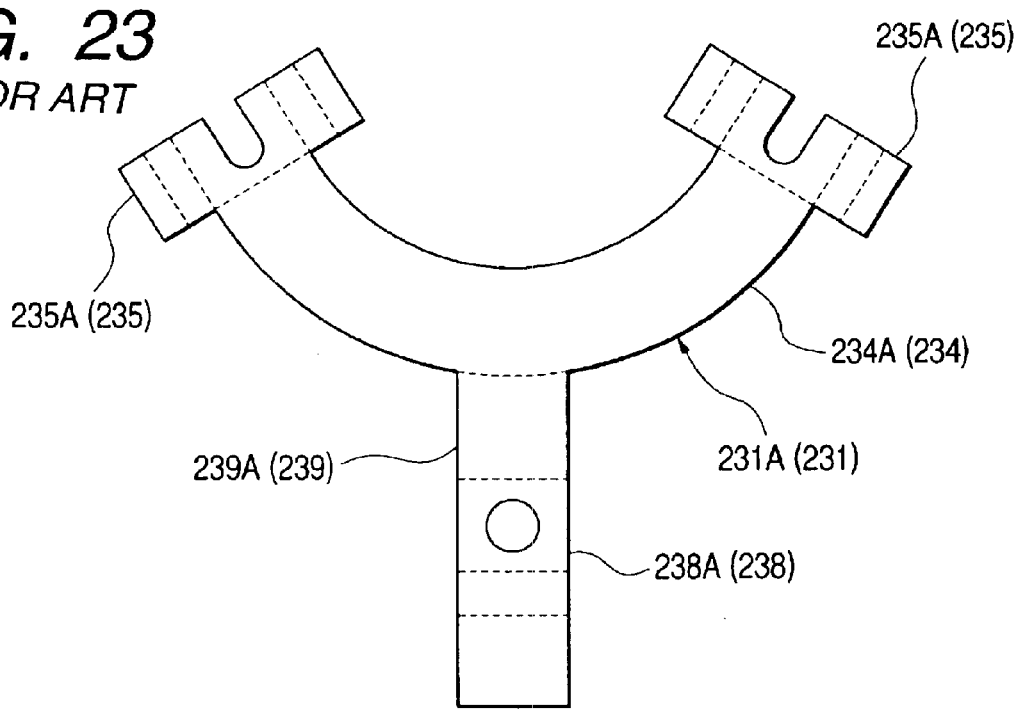
FIG. 23 PRIOR ART
FIG. 23 is a developed view of the terminal body of FIG. 22.
Figure 24:
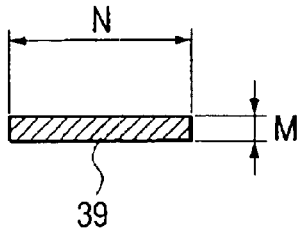
FIG. 24 PRIOR ART
FIG. 24 is a sectional view taken along a line T—T of FIG. 22.

As the recessed portions 91 and 92 and the convex portion 93 engage with each other by utilizing the elasticity of the terminal body 50 and the operating lever 60 themselves, these are set in such a relation as to have some overlap margin δ3 as shown in FIG. 8B.

The battery terminal 110 according to this embodiment has the following advantages.

First, the convex portions 93 on the side of the operating lever 60 elastically engage with the respective recessed portions 91 on the side of the terminal body 50 to ensure that the operating lever 60 is provisionally held in the preceding upright position. Therefore, any useless movement of the operating lever 60 due to gravity, vibration or the like becomes preventable and the adaptor fitting portion 51 of the battery terminal 110 can thus be admitted into the battery post adaptor 12.

When the adaptor fitting portion 51 is pressed against the battery post adaptor 12 through the operation of turning the operating lever 60 laterally and pressing the cam portion 66, as the convex portions 93 engage with the respective recessed portions 92 in the position where the operating lever 60 is completely pivoted, the operator is allowed to decide that the operation has been completed from the touch.

Even though the installation work is done without paying any special attention to which position the operating lever 60 should be pivoted, the operating lever 60 can be stopped at a predetermined position. Thus a constant pivoting amount is always secured, whereby the pressing force toward the battery post adaptor 12 can be controlled constantly, which results in improving contact reliability.

When the press-contact of the adaptor fitting portion 51 against the battery post adaptor 12 is released by returning the operating lever 60 to the upright position, it is possible to decide whether the operating lever 60 has been properly returned thereto from the touch of the provisional holding resulting from the engagement between the convex portions 93 and the recessed portions 91.

Since the elasticity of the side plates 52 and 62 of the terminal body 50 and the operating lever 60 serves as what can make the convex portions 93 and the recessed portions 91 and 92 elastically engage with each other, the operating lever is only needed to be moved with force greater than the predetermined degree, whereby the provisional holding resulting from the engagement between the convex and recessed portions 93, 91 and 92 is released and the operating lever 60 can freely be made pivotal without any obstruction to the pivoting operation. Moreover, as clicking is felt at the time of their engagement to have the provisional holding confirmed, that is, the clicking allows deciding whether or not the operating lever 60 is in the upright position or the position where the pivoting operation is completed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A battery terminal structure for connecting a terminal provided with an electric wire with a stud bolt type battery post, comprising:

an adapter, having a cylindrical body which is screwed onto the battery post, and a flange portion formed at a top of the cylindrical body to be clamped by a screwing tool;

a terminal body, including a substantially U-shaped adaptor fitting portion which accommodates the adapter screwed on the battery post therein, and a seat portion on which the terminal provided with the electric wire is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position; and wherein the flange portion of the adaptor overhangs a top end face of the adapter fitting portion of the terminal body.

2. The battery terminal structure as set forth in claim 1, wherein the flange portion of the adaptor has a hexagonal shape such that a dimension between opposite faces is no less than an outer diameter of the cylindrical body of the adaptor.

3. The battery terminal structure as set forth in claim 1, further comprising an engagement member, which provisionally retains the lever in at least one of the first position and the second position.

4. The battery terminal structure as set forth in claim 1, further comprising an elastic member provided in either one of the lever or the terminal body for bringing the cam portion into an elastic contact with the adaptor.

5. The battery terminal structure as set forth in claim 1, wherein the terminal body is made of a single metal plate.

6. The battery terminal structure as set forth in claim 1, wherein a dimension between an outer side faces of the adaptor fitting portion is equal to a dimension between an outer side faces of the terminal body where the seat portion is provided.

7. The battery terminal structure as set forth in claim 1, wherein the terminal provided with the electric wire is fixed on the seat portion with a stud bolt and a nut; and wherein the lever includes a through hole which accommodates the nut therein when the lever is in the second position.

8. A battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the terminal provided with the electric wire is fixed;

a lever, including a cam portion and supported on the terminal body so as to be pivotable between a first position and a second position; and an engagement member, which provisionally retains the lever in at least one of the first position and the second position, wherein a space in which the flange portion is capable of passing through is secured inside of the adaptor fitting portion when the lever is in the first position; and wherein the cam portion is abutted against an outer periphery of the cylindrical body of the adaptor so that the adaptor is retained between the cam portion and an inner face of the adaptor fitting portion, when the lever is in the second position.

9. The battery terminal structure as set forth in claim 8, wherein the engagement member includes a recessed portion formed on one of the terminal body and the lever, and a convex portion engaged with the recessed portion formed on the other of the terminal body and the lever.

10. The battery terminal structure as set forth in claim 8, wherein a flange portion is formed at a top portion of the cylindrical body of the adaptor; and wherein the flange portion overhangs a top end face of the adaptor fitting portion of the terminal body.

11. The battery terminal structure as set forth in claim 8, further comprising an elastic member provided in either one of the lever or the terminal body for bringing the cam portion into an elastic contact with the adaptor.

12. The battery terminal structure as set forth in claim 8, wherein the terminal body is made of a single metal plate.

13. The battery terminal structure as set forth in claim 8, wherein a dimension between an outer side faces of the adaptor fitting portion is equal to a dimension between an outer side faces of the terminal body where the seat portion is provided.

14. The battery terminal structure as set forth in claim 8, wherein the terminal provided with the electric wire is fixed on the seat portion with a stud bolt and a nut; and wherein the lever includes a through hole which accommodates the nut therein when the lever is in the second position.

15. A battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool, a terminal body, including a substantially U-shaped adaptor fitting portion which accommodates the adapter screwed on the battery post therein, and a seat portion on which the terminal provided with the electric wire is fixed;

a lever, including a cam portion and supported on the terminal body so as to be pivotable between a first position and a second position; and an elastic member provided in either one of the lever or the terminal body for bringing the cam portion into an elastic contact with the adaptor, wherein a space in which the flange portion is capable of passing through is secured inside of the adaptor fitting portion when the lever is in the first position; and wherein the cam portion is abutted against an outer periphery of the cylindrical body of the adaptor so that the adaptor is retained between the cam portion and an inner face of the adaptor fitting portion, when the lever is in the second position.

16. The battery terminal structure as set forth in claim 15, wherein the elastic member is a plate spring which constitutes the cam portion of the lever.

17. The battery terminal structure as set forth in claim 16, wherein the plate spring is extended along an outer periphery of the cam portion such that a first end portion of the plate spring is fixed on the lever member and a second end portion of the plate spring is movable retained at the cam portion.

18. The battery terminal structure as set forth in claim 15, wherein a flange portion is formed at a top of the cylindrical body of the adaptor; and wherein the flange portion overhangs a top end face of the adaptor fitting portion of the terminal body.

19. The battery terminal structure as set forth in claim 15, further comprising an engagement member, which provisionally retains the lever in at least one of the first position and the second position.

20. The battery terminal structure as set forth in claim 15, wherein the terminal body is made of a single metal plate.

21. The battery terminal structure as set forth in claim 15, wherein a dimension between an outer side faces of the adaptor fitting portion is equal to a dimension between an outer side faces of the terminal body where the seat portion is provided.

22. The battery terminal structure as set forth in claim 15, wherein the terminal provided with the electric wire is fixed on the seat portion with a stud bolt and a nut; and wherein the lever includes a through hole which accommodates the nut therein when the lever is in the second position.

23. A battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the terminal provided with the electric wire is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position;

wherein the terminal body is made of a single metal plate including a first portion which is bent in a thickness direction thereof to form the adaptor fitting portion, a second portion extended perpendicularly from a first end of the first portion, and a third portion extended perpendicularly from a second end of the first portion; and wherein the second and third portions are bent so as to be overlapped with each other to form the seat portion.

24. The battery terminal as set forth in claim 23, wherein the terminal provided with the electric wire is fixed on the seat portion with a stud bolt inserted through a through hole formed in the seat portion and a nut screwed onto the stud bolt.

25. The battery terminal as set forth in claim 24, wherein a retaining piece is integrally formed on either one of the second and third portions of the metal plate; and wherein the retaining piece is bent to form a retaining member which retains a head portion of the stud bolt.

26. The battery terminal structure as set forth in claim 23, wherein a flange portion is formed at a top of the cylindrical body of the adaptor; and wherein the flange portion overhangs a top end face of the adaptor fitting portion of the terminal body.

27. The battery terminal structure as set forth in claim 23, further comprising an engagement member, which provisionally retains the lever in at least one of the first position and the second position.

28. The battery terminal structure as set forth in claim 23, further comprising an elastic member provided in either one of the lever or the terminal body for bringing the cam portion into an elastic contact with the adaptor.

29. The battery terminal structure as set forth in claim 23, wherein a dimension between an outer side faces of the adaptor fitting portion is equal to a dimension between an outer side faces of the terminal body where the seat portion is provided.

30. The battery terminal structure as set forth in claim 24, wherein the lever includes a through hole which accommodates the nut therein when the lever is in the second position.

31. A battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the terminal provided with the electric wire is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position; and wherein a dimension between an outer side faces of the adaptor fitting portion is equal to a dimension between an outer side faces of the terminal body where the seat portion is provided.

32. The battery terminal structure as set forth in claim 31, wherein a flange portion is formed at a top of the cylindrical body of the adaptor; and wherein the flange portion overhangs a top end face of the adaptor fitting portion of the terminal body.

33. The battery terminal structure as set forth in claim 31, further comprising an engagement member, which provisionally retains the lever in at least one of the first position and the second position.

34. The battery terminal structure as set forth in claim 31, further comprising an elastic member provided in either one of the lever or the terminal body for bringing the cam portion into an elastic contact with the adaptor.

35. The battery terminal structure as set forth in claim 31, wherein the terminal body is made of a single metal plate.

36. The battery terminal structure as set forth in claim 31, wherein the terminal provided with the electric wire is fixed on the seat portion with a stud bolt and a nut; and wherein the lever includes a through hole which accommodates the nut therein when the lever is in the second position.

37. A battery terminal structure for connecting a terminal provided with an electric wire with a stud bolt type battery post, comprising:

an adapter, having a cylindrical body which is screwed onto the battery post, and a flange portion formed on the cylindrical body to be clamped by a screwing tool;

a terminal body, including a substantially U-shaped adaptor fitting portion which accommodates the adapter screwed on the battery post therein, and a seat portion on which the terminal provided with the electric wire is fixed; and a lever, including a cam portion and supported on the terminal body so as to be pivotable between a first position and a second position, wherein a space in which the flange portion is capable of passing through is secured inside of the adaptor fitting portion when the lever is in the first position;

wherein the cam portion is abutted against an outer periphery of the cylindrical body of the adaptor so that the adaptor is retained between the cam portion and an inner face of the adaptor fitting portion, when the lever is in the second position;

wherein the terminal provided with the electric wire is fixed on the seat portion with a stud bolt inserted through a through hole formed in the seat portion and a nut screwed onto the stud bolt; and wherein the lever includes a through hole which accommodates the nut therein when the lever is in the second position.

38. The battery terminal structure as set forth in claim 37, wherein a flange portion is formed at a top of the cylindrical body of the adaptor; and wherein the flange portion overhangs a top end face of the adaptor fitting portion of the terminal body.

39. The battery terminal structure as set forth in claim 37, further comprising an engagement member, which provisionally retains the lever in at least one of the first position and the second position.

40. The battery terminal structure as set forth in claim 37, further comprising an elastic member provided in either one of the lever or the terminal body for bringing the cam portion into an elastic contact with the adaptor.

41. The battery terminal structure as set forth in claim 37, wherein the terminal body is made of a single metal plate.

42. The battery terminal structure as set forth in claim 37, wherein a dimension between an outer side faces of the adaptor fitting portion is equal to a dimension between an outer side faces of the terminal body where the seat portion is provided.

43. An adaptor attached to a stud bolt type battery post and fitted with a battery terminal, comprising:

a cylindrical body which is screwed onto the battery post and surrounds the battery post; and a flange portion formed at a top of the cylindrical body to be clamped by a screwing tool, wherein the flange portion overhangs a top end face of the battery terminal.

44. The adaptor as set forth in claim 43, wherein the flange portion has a hexagonal shape such that dimension between opposite faces is less than an outer diameter of the cylindrical body.

45. A method of manufacturing a battery terminal which connects a terminal provided with an electric wire and a stud bolt type battery post, comprising the steps of:

providing a single metal plate including a first portion, a second portion extended perpendicularly from a first end of the first portion, and a third portion extended perpendicularly from a second end of the first portion;

bending the first portion into a substantially U-shape in a thickness direction thereof to form an adaptor fitting portion which accommodates an adaptor screwed onto the battery post in the U-shaped portion; and bending the second and third portions so as to be overlapped with each other to form a seat portion on which the terminal provided with the electric wire is fixed.

46. The adaptor as set forth in claim 43, wherein the flange portion has a hexagonal shape such that a dimension between opposite faces is equal to or slightly greater than an outer diameter of the cylindrical body.

* * * * *